United States Patent [19]

Gane et al.

[11] 3,967,751

[45] July 6, 1976

[54] EASY OPEN END

[75] Inventors: Gordon R. Gane, Pleasanton; Lawrence C. Hoffmann, Jr., Oakland, both of Calif.

[73] Assignee: Kaiser Aluminum & Chemical Corporation, Oakland, Calif.

[22] Filed: June 13, 1975

[21] Appl. No.: 586,671

[52] U.S. Cl. ..... 220/268

[51] Int. Cl.[2] ..... B65D 41/32

[58] Field of Search ..... 220/265, 266, 268; 222/541; 229/7 R

[56] References Cited

UNITED STATES PATENTS

| | | | |
|---|---|---|---|
| 3,794,206 | 2/1974 | DeLine et al. | 220/268 |
| 3,902,626 | 9/1975 | Jordan et al. | 220/268 |
| 3,902,627 | 9/1975 | Gane | 220/268 |
| 3,912,114 | 10/1975 | Morran et al. | 220/268 |

*Primary Examiner*—George T. Hall
*Attorney, Agent, or Firm*—Paul E. Calrow; John S. Rhoades

[57] ABSTRACT

This invention relates to an improved easy open ecological closure member for containers as well as processes and equipment for producing the same. The container closure member is provided with one or more readily depressible and hinged opening tabs or buttons, that do not readily separate from the closure member upon becoming depressed due to the novel structure and arrangement of the buttons, their base portions and their frangible tear line sections all of which contribute to a selective concentration of stresses in the frangible tear line sections during opening.

21 Claims, 17 Drawing Figures

EASY OPEN END

RELATED APPLICATIONS

This application is directed to easy open closure member improvements over those disclosed and claimed in Gordon R. Gane applications Ser. Nos. 478,407, filed June 11, 1974, now U.S. Pat. No. 3,902,627, and 565,494 filed Apr. 7, 1975 both entitled "Easy Open End," and Design Applications Des. Ser. Nos. 448,096-9, inclusive, filed Mar. 4, 1974, each of which is entitled "End Closure for a Container."

BACKGROUND OF THE INVENTION

This invention relates to easy open metal container end closures or closure members and particularly to those provided with preformed tabs of the type disclosed in the aforementioned Gane applications and that are adapted to be depressed or pushed in manually to gain access to the contents of the container to which an end closure provided with such tabs is attached as well as processes and equipment for producing the same. Upon being depressed, the instant tabs do not become readily separated from their associated end closures to become lost and thereby further contribute to the litter problem as is the case with conventional pull ring tear tabs.

At the present time, metal container end closures employing metal pull rings or pull tear tabs still comprise the bulk of commercially produced easy open end closures. These rings or tabs become readily separated from their respective container closures upon opening and unless deposited in a refuse can are frequently dropped upon the ground or overboard from a boat, to become litter as well as possible hazards to marine life, or to people walking barefoot in areas such as beaches where the tabs fall upon the ground and become buried in the sand.

Not only have the separable metal pull rings or tabs created significant litter problems to the point, where at least one state has prohibited the use of containers provided with such rings within the state, they also involve a substantial number of precise manufacturing steps or procedures and the extra metal required to produce the pull rings. Since a pull ring tab is normally attached to a rivet formed integrally with the closure member, care must be exercised in attaching the ring tab to the rivet to prevent the rivet from being destroyed or weakened whereby the closure member will not pass quality control inspections during manufacture.

Attempts have been made in the past to overcome the various problems presented by the pull ring type easy open closure members by avoiding the use of such separable pull rings in favor of push button type tabs formed integrally with the closure member proper. Examples of such push button tabs for closure members are shown in the aforesaid Gane applications as well as U.S. Pat. Nos. 2,120,186, 2,187,433, 2,261,117, 3,362,569, 3,246,791, 3,355,058, 3,741,432, 3,779,417, 3,794,206, 3,760,752, 3,759,206, 3,843,011, 3,881,630 and Design Pat. No. 226,171, page 9 of the "Wall Street Journal" for May 23, 1973, and the Federal Republic of Germany published (Offenlegungsschrift) Pat. application No. 2,341,077 of Apr. 18, 1974. In the easy open container closures of several of these United States patents, the push button opening tab is adapted during manufacture to be first completely fractured or severed from the container closure proper except for a small hinge and then pushed back into place and sealed to the container closure proper by means of an appropriate plastic sealant. These plastic sealed closure tabs, however, are difficult to make leakproof and sanitary on a mass production basis and, in any event, are still relatively expensive to produce because of the number of complex manufacturing steps and tooling involved plus the sealant materials required.

SUMMARY OF THE INVENTION

The instant easy open closure developments constitute improvements in the design, construction and manufacture of the prior art push button container closures of the type represented by the Gane applications as well as the aforementioned patents and publications. The instant easy open container closure member is adapted to be made out of a suitable ductile metal and is provided with one or more improved easy open button-like depressible tab elements. These tab elements are formed integrally with the metal of the container closure in such a way as not to be completely fractured or severed from the closure member proper during manufacture or require resealing with a plastic material or the like as in the case, for example, of the closure of U.S. Pat. No. 3,759,206. Each button-like depressible tab of the closure member prior to opening effectively resists outward opening caused by pressures generated by the contents of the container to which the closure member is attached. Yet the same depressible tab even when having a relatively large overall dimension is capable of being readily manipulated and opened inwardly with a relatively small amount of force by the finger of the user and without the requirement of any special tool. Once opened, the tab is adapted to remain in a selected pushed-in or depressed position while the contents are emptied from the container to which the closure member bearing the tab is attached.

The improved, easy-to-open, yet internal pressure-resistant characteristics of the button-like depressible tabs of the instant invention are due to the novel structure, arrangement and angular disposition of the tabs proper and their associated base and improved frangible tear sections. The structure, arrangement and angular disposition in turn of various portions of the base and tear line sections of the depressible opening tabs with respect to the other portions of the tabs and their associated closure members, such as selectively embossed portions of the closure members, provide, among other things, for selected focal points of stress concentration in the frangible tear line areas of the tabs during opening and resistance to internal pressures such as are generated by the containers contents prior to opening.

As in the case of the end closure members of the prior Gane application Ser. No. 478,407 and as will be described hereinafter, various parts of the depressible tabs are generally arranged to simulate opposed intersecting geometric cone-like figures that help to selectively distribute the stresses upon the frangible tear sections. In the instant case, moreover, various parts of a tab are also selectively differentially work hardened during manufacture to further help establish a focal point of stress concentration and a selective initial fracture of the tab's residual or tear section upon the depression of the tab. Such differential work hardening, however, does not adversely affect the normal resistance of the tabe tear line sectors to fractures from the build-up of internal pressures generated by the contents of a container provided with the tab prior to opening.

In a further advantageous embodiment of the invention, means are provided, such as suitable upstanding embossments somewhat analogous to those of U.S. Pat. No. 3,450,301 on and end closure member having a depressible tab of the instant invention in order to protect the tab and prevent accidental opening of the same during the usual seaming and sealing of the end closure member to a metal container, such as a beer or beverage can, as well as during other end closure member handling and stacking operations, etc.

In the ensuing discussion, it is to be understood that the terms "closure member" or "end closure"to as used throughout the specification and claims are meant to include closures made from all types of appropriate ductile metal materials, such as steel, tin plate, aluminum and its alloys, and other metals which are suitable for manufacturing the container closures, as well as container closures made of these metals and provided with relatively thin plastic films and coatings customarily used to protect the metal against the contents of the containers and vice versa and container closures of other than circular configurations.

DETAILED DESCRIPTION

Figure 1:
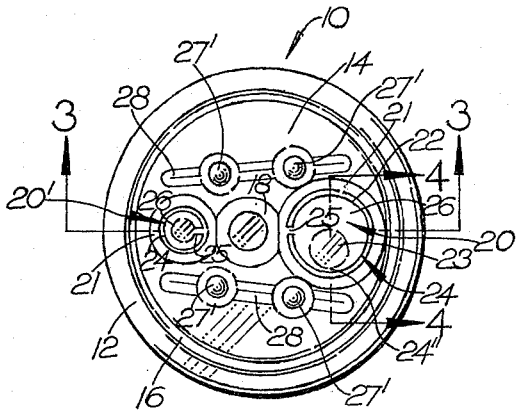
FIG. 1 is a top plan view of an improved easy open container closure member of the instant invention.

With further reference to the drawings and, in particular, FIGS. 1 through 4D, the improved container closure member 10 of the instant invention is generally comprised of an outer peripheral reinforcing rim 12, adapted to be lock seamed in the standard fashion to the top of a container such as a beverage container and a central panel portion or area 14. Closure member 10 is further provided with the usual lower peripheral reinforcing annular rib or countersink 16 and an embossment 18 of appropriate configuration, such as a hemispherical or a frustoconical configuration and which can be disposed at or adjacent the center of panel portion 14.

Figure 2:
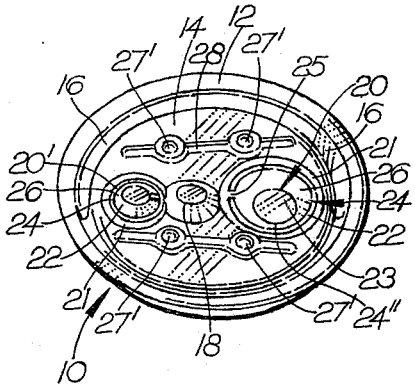
FIG. 2 is a perspective view of the closure member shown in FIG. 1.
Figure 3:
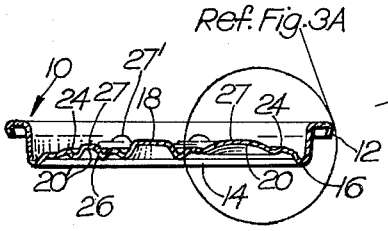
FIG. 3 is a cross-sectional view taken along the line 3—3 of FIG. 1.

In a preferred embodiment of the invention, at least one button-like element or depressible opening tab is disposed intermediate the central embossment 18 and a given sector of rib 16. In many instances and as indicated in FIGS. 1–3, a separate tab can be located to either side of an intermediate embossment 18 and rib 16. One of these tabs 20 can be made larger than the other tab 20' and they provide access to the contents of a container provided with the closure member 10. The embossment 18 has several functions. Firstly, it reinforces and strengthens the closure member panel area 14. Secondly, it reduces the flexibility of the panel area 14 by stiffening the same thereby helping to concentrate stresses in the frangible tear line sections of the depressible tabs 20 and 20' during opening of the same.

In a preferred embodiment of the invention, the depressible large and small tabs 20 and 20' each advantageously include substantially annular primary and secondary base portions 21 and 22 respectively. Base portions 21 and 22 are also preferably vertically offset and at least the tops thereof are preferably horizontally offset with respect to each other as well as being concentrically arranged and interconnected by an angularly disposed web portion 24, while the inner extremity of base portion 22 merges with the bottom of the upwardly projecting wall 26 of a finger engaging dome-like section 27. This dome-like section 27 can take various forms. One embodiment of the invention contemplates that a tab dome section 27 can approximate a segment of a sphere in configuration or as indicated by the small tab 20′ of FIG. 2, it may approximate the form of a truncated cone. One or more of the tabs, such as the larger tab 20, is also advantageously provided with an improved force application indicator means, such as an eccentric or off-center raised dome segment 23′, that is fully integrated with the structure of the dome section.

Figure 4:
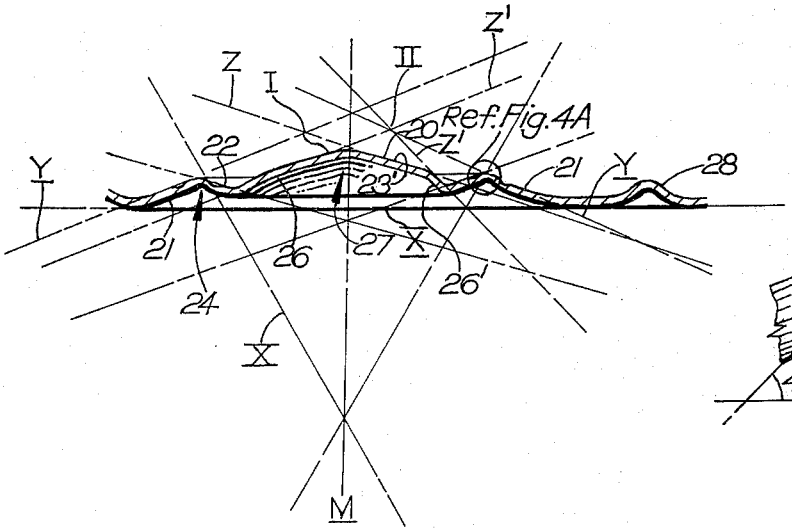
FIG. 4 is a cross-sectional view taken along the line 4—4 of FIG. 1 wherein other base, frangible tear line and side wall sections of the tab are likewise projected along hypothetical cone-like projection lines to indicate the unique opposed geometrical, cone-like relationship of other elements making up the tab.
Figure 4A:
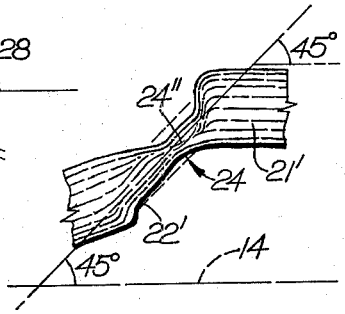
FIG. 4A is an enlarged sectional view of the frangible portion of the tab of FIG. 4, when taken within the circumscribing line 4A of FIG. 4 and with parts removed.
Figure 4B:
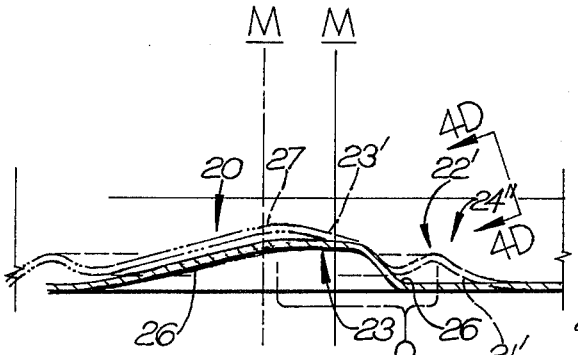
FIG. 4B is a cross-sectional view of the tab similar to that of FIG. 4, when partially formed by the first station tooling shown in FIG. 6, and if viewed along line 4B—4B of the FIG. 6 tooling and with the final configuration of the tab being shown in dotted lines.
Figure 4C:
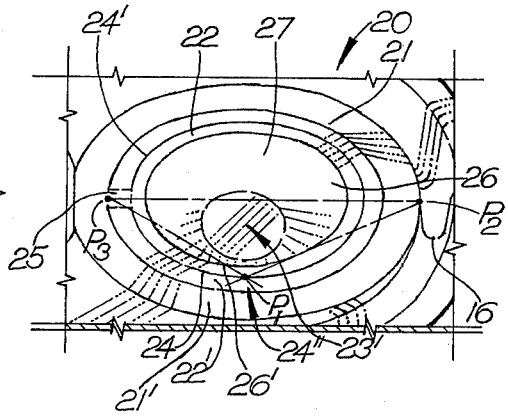
FIG. 4C is an enlarged perspective view of the improved finally formed tab of the instant invention.
Figure 4D:
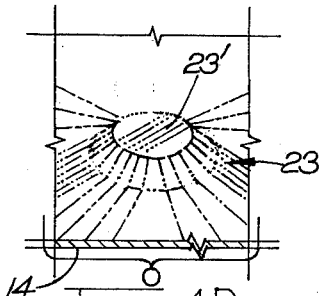
FIG. 4D is a view taken along line 4D—4D of FIG. 4B with parts removed.

As indicated particularly in FIGS. 3–4D, the primary and secondary base portions 21 anad 22 of a tab which have hoop-like strength characteristics, project at selected angles to each other with the primary base portion 21 being inclined generally upwardly and inwardly while the secondary base portion 22 projects in a generally inwardly and downwardly direction until it merges with the bottom of the side wall 26 of dome-like section 27.

The web 24 joining the tops of tab base portions 21 and 22 includes a frangible annular tear line 24′ that extends in a preferred embodiment of the invention for the major length of the web 24 until it is split by and merges with the hinge portion 25. In one embodiment of the invention, hinge portion 25 can be located closely adjacent to the central portion of the panel area 14 across from or in opposition to the reinforcing rib 16. The tear line portion 24′ overall is of materially less thickness and more brittle than the adjacent base sections 21 and 22 and can be advantageously differentially work hardened in parts as will be subsequently described in detail. Thus when an inward force is applied directly to the dome-like section 27 of a tab such as tab 20 this inward force will tend to be concentrated in a selected sector of the tear line 24′ whereby the tear line 24′ will readily fracture as stresses build up in this tear line sector. When the rupture of tear line 24′ of a tab is initiated, preferably at a point remote from the somewhat downwardly directed tab hinge 25, dome-like section 27 will then pivot downwardly and inwardly about hinge 25 and without normally becoming fully separated from the closure member 10.

Figure 3A:
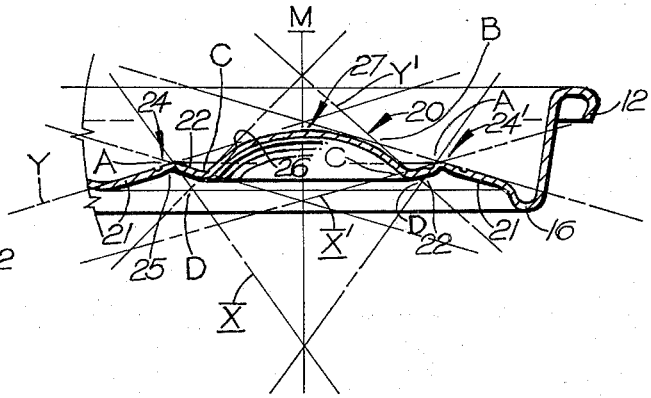
FIG. 3A is an enlarged fragmentary sectional view of the closure member shown in FIG. 3 when taken within the circumscribing line 3A of FIG. 3, wherein certain base, frangible tear line and side wall sections of a tab are projected along hypothetical cone-like projection lines to indicate the unique opposed geometrical, cone-like relationships of various elements making up the tab.

As indicated particularly in FIG. 3A and as set forth in Gane application Ser. No. 478,407, the various inclined surfaces of base portions 21, 22, as well as the inclined web section 24′ and the normal planes or slopes of the generally symmetrical portions of the wall 26 of dome section 27 adjacent their points of mergence with base 22 when hypothetically projected along the dotted lines of FIG. 3A, generate a pair of upwardly facing geometrical cone-like figures X and X′ and a pair of opposing downwardly facing geometrical cone-like figures Y and Y′. Certain of these figures ultimately intersect each other at the several spaced points A, B, C and D located at various peripheral portions of the depressible tab dome section 27 with point C being generally the point of mergence of dome section wall 26 with base portion 22. Projected geometrical cone-like figures X and Y′ are somewhat deeper figures than figures X′ and Y and in a preferred embodiment of the invention the apices of all the various cone-like figures of FIG. 3A which depict the generally symmetrical portion of dome section 27 are generally aligned along the main vertical tab axis M.

As further indicated in FIG. 3A, the interrelationship of these various elements making up a tab, e.g. base sections 21, 22, web 24, and wall 26, considered as parts of hypothetically projected cone-like figures, is of significance in the manipulation of the dome section 27 and the ease with which the tear line 24′ is fractured when a small amount of inward force is applied to the dome section 27 by the finger of the operator. Because of the thinness and work hardened characteristics of tear line portion 24′ of a tab plus the relationship and interaction of the opposed projection cone-like figures X, X′ and Y and Y′, and as previously noted a closure member embossment, e.g. embossment 18, the initial force applied by the dome-like section 27 upon an inward opening movement is translated through the inclined secondary base section 22 directly into the frangible tear line 24′ where the resultant concentration of what are believed to be primarily tensile stresses force a rapid rupture or fracture of line 24′. In other words, the inward force exerted by a dome section 27 is resisted by its associated base sections 21 and 22 then translated and converted to the aforesaid tensile stresses on the residual and weakened tear line section 24′. At the same time, it is to be observed with reference to FIG. 3A that the point of intersection D of the bases of the hypothetical cone-like figure X projected from web 24 and opposed cone-like figure Y′ projected from the normal plane or slope of wall 26 in the area of mergence of wall 26 and base 22 is preferably somewhat below the tear line 24′ whereby there is little resistance to fracture of line 24′.

During the process of depressible tab manufacture, the tear line portion 24′ of web section 24 is reduced substantially in cross-sectional thickness from the other cross-sectional portions of the panel area 14 of closure member 10 by virtue of the tool forming pressures exerted on web section 24 such that there is preferably a bilateral pinch scoring and substantial work hardening of the web 24 in the area of tear line 24′. This work hardening results in the distorted grain structure shown schematically in FIG. 4A for the tear line 24′, as the values of the relative yield and tensile strengths of tear line area 24′ and in particular tear line sector 24″ of tab 20 are brought relatively close together. The thinning of the metal in the area of tear line 24′, while leaving the hinge 25 thicker and substantially at or closer to the original thickness of the closure blank, causes a substantial reduction in the overall ductility of the material in tear line 24′ and in particular tear line sector 24″ of tab 20 in a manner to be described and it becomes brittle. Thus, in the final article when relatively small tensile stresses are concentrated in tear line 24′ and particularly in sector 24″ thereof, the tear line will preferentially sequentially fracture, with initial fracture taking place in tear line sector 24″ because of its weakened, more work hardened and embrittled condition relative to the remaining sectors of tear line 24′.

Despite the relative ease with which line 24 fractures when an externally inward force is applied to the dome-like section 27, the angular disposition of all of tear line 24′ relative to the base sections 21 and 22 and to the general plane of panel area 14 together with the hoop-like strength characteristics of base sections 21 and 22, make tear line 24′ highly resistant to stresses resulting from internal pressures.

The discussion of the depressible tabs 20 and 20′ thus far has been concerned with what can be considered generally symmetrically shaped tabs or at least the symmetrically shaped portions of the tabs, i.e., the base elements 21, 22, web 24 with its tear line 24′ and the portions of dome-like section 27 that are generally symmetrical and have an overall spherical, hemispherical, or frusto-conical configuration, etc. It has been found that the ease of opening of the tabs and particularly that of large sized tab 20, can be noticeably enhanced, if while retaining the other advantages, structural features and configuration of the tabs as previously described, the tear line section 24' of a tab e.g. the large tab is differentially work hardened in parts or more embrittled in a predetermined area 24'' remote from the hinge 25 of web 24 and adjacent a force application indicator such as a raised surface element 23' which is disposed in an offset or eccentric fashion relative to vertical axis M of tab dome section 27, than in other tear line section areas. Although in the ensuing discussion a differentially work hardened tear line sector 24'' and eccentric surface element 23' will be discussed with particular reference to their incorporation in the structure of the large tab 20, that can be the single tab used, it will be understood that such features can be used in both opening tabs when two such tabs are used.

In an advantageous embodiment of the invention, to be hereinafter described, the process and equipment employed to produce the eccentric surface element 23' can also be advantageously utilized to differentially work harden the various sectors of the tear line section 24' and contiguous areas in the end closure 10.

In the case of a tab 20 or 20' provided with such an element 23', the simulated opposed intersecting geometric cone-like figure relationship previously described will still exist, but with the modifications indicated particularly in FIGS. 4, 4B and 4C. By reference to FIG. 4, it will be observed that the inclined surfaces of base elements 21, 22 and web tear line section 24' of the tab cross-section illustrated in FIG. 4, when hypothetically projected or plotted along the dotted lines of FIG. 4, generate the geometrical cone-like figures X, X' and Y, that are still generally symmetrical relative to the central vertical axis M of the finished tab 20. The projection of the surfaces or planes produced by eccentric raised surface element 23' and the diametrically opposed section of wall 26 adjacent base section 22 generate a cone-like figure Z, while the projection of the small wall section 26' of wall 26 intermediate tear line sector 24'' and eccentric surface element 23' and the diametrically opposed section of wall 26 adjacent base section 22 generate a cone-like figure Z'. Cone-like figures Z and Z' have the respective apices I and II, that are somewhat offset relative to the central vertical axis M of the tab 20. In any event, the interaction and relationship of the opposed and projected cone-like figures X, X', Y, Z and Z' are such that, when an initial force is applied to the dome-like section 27 and in particular to the eccentric surface element 23' thereof, it will still be translated through the inclined secondary base section 22, and primarily through the sector 22' of base section 22 contiguous to element 23', and then directly and initially into the relatively more work hardened tear line sector 24'', where the resultant concentration of what are believed to be primarily tensile stresses initiate a rupture of tear line sector 24'' located approximately 90° counter clockwise from hinge 25 in FIG. 1, followed by the fracturing of the remainder of tear line 24'. In other words, the structure of a tab provided with a differentially work hardened tear line sector and a raised eccentric element promotes initial fracture at a selected tear line point that is advantageously adjacent the eccentric element but remote from the tab hinge 25. Thus tear line sector 24'' can be said to constitute the focal point of stress concentration upon depression of tab 20.

As in the case of the closure member of the aforesaid Gane application Ser. No. 478,407, it is contemplated that appropriate upstanding embossments would be provided in the panel portion 14 to protect depressible tabs 20 and 20' against accidental opening, particularly when end closures bearing such tabs are lock seamed by the usual container end seaming tools to the open end of a container, such as a beverage container, as well as during other end closure mechanical handling or stacking operations, etc. In order to provide such protection, end closure 10 is advantageously provided with protective as well as stiffening embossments 27' of less height than the end closure rim 12 before and after attachment of the end closure to a container. In one embodiment of the invention, such embossments are located adjacent the central panel portion of the end closure. Embossments 27' are adapted to be engaged by the stripper elements of a standard can end seaming tool during stripping of the sealed and seamed container from the seaming tool rather than the push button tabs 20, 20' to preclude contact and accidental opening of the latter. These same embossments 27 may, if desired, be combined or integrated with further upstanding bar or rib-type embossments 28 arranged in a converging fashion and on opposite sides of tabs 20 and 20'. The height of embossments 27', which can take various shapes, e.g., hemispherical or beadlike as shown in FIGS. 1–3, should be greater than the heights of both tabs 20, 20' and embossment 18. In addition to serving as a base for the secondary and protective embossments 27', the embossments 28 provide for stiffening of the panel closure area 14, whereby it is less susceptive to being deflected improperly or adversely during the depressing and opening of tabs 20 and 20', etc. Instead of converging in the fashion shown in FIGS. 1 and 2, the reinforcing and protective embossments 27' and 28 may be arranged in a generally parallel fashion.

FIGS. 5–10 illustrate in a preferred embodiment of the invention die equipment and a two-step cold working process that can be used without prior annealing to initially and finally shape dimples in the closure member 10 which ultimately become the embossment 18 and depressible tabs 20 and 20' of such closure member. This two-step process can involve tooling of the type generally shown in FIGS. 5–10 when affixed to an overall die press of the type discussed in the aforementioned Gane application Ser. No. 478,407 and provided with at least two forming stations.

Figure 5:
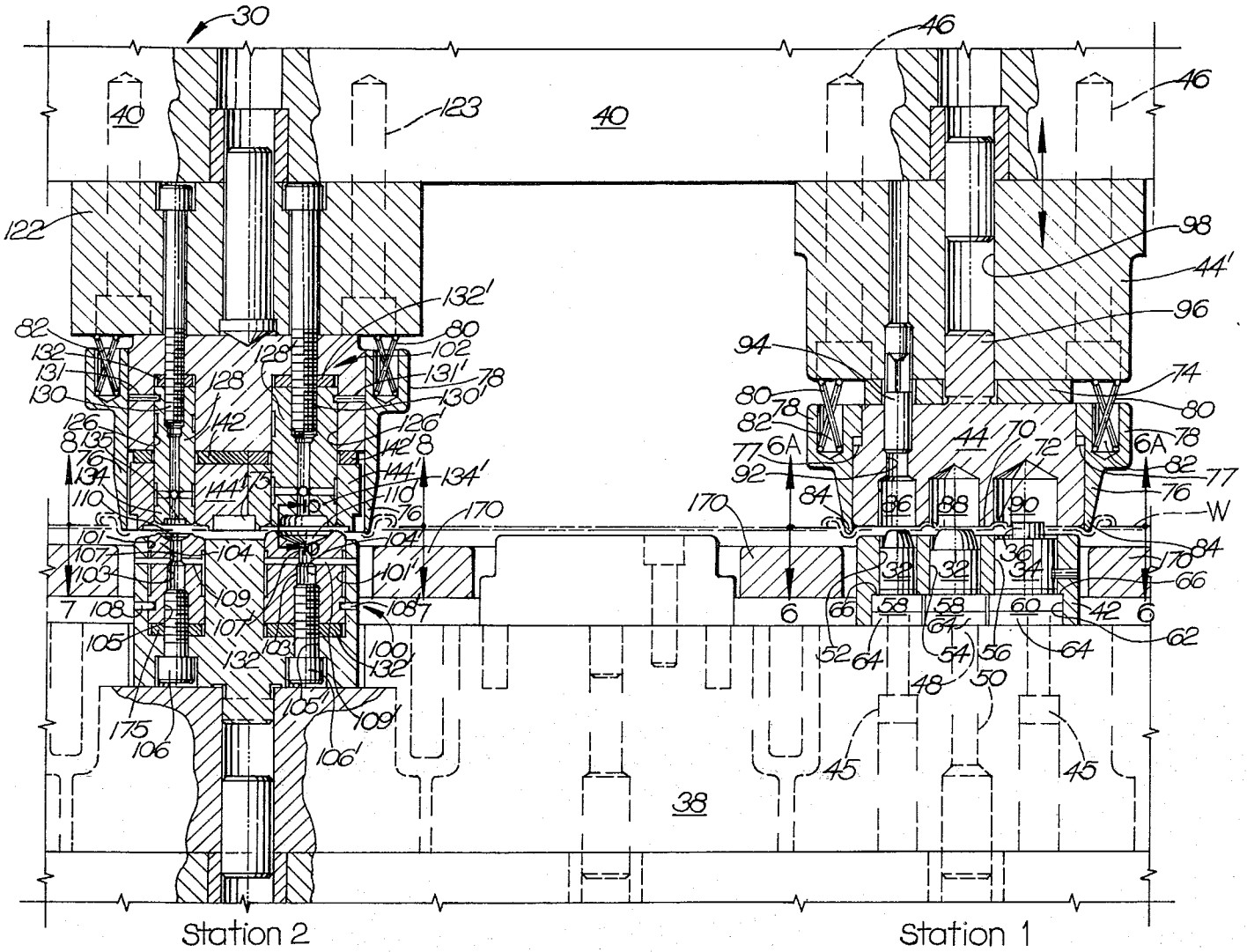
FIG. 5 is a partial cross-sectional view of a suitable tooling arrangement that can be used to produce closure members provided with the improved opening tab of the instant invention.

The closures 10, which could be previously coated with an appropriate thin plastic coating and formed to the extent of having a rim 12, central flat panel area 14, and rib 16, can be fed intermittently and successively from the first station to the second station of the press 30 by way of a standard intermittently movable and somewhat flexible metal webbing or belt conveyor W indicated in dotted lines in FIG. 5. Belt conveyor W is provided with appropriately spaced openings for receiving and holding the closures in position at the various work stations.

In general, the initial forming of dimples in the metal closure member panel area 14, which ultimately become the central embossment 18 and depressible tabs 20 and 20' of FIG. 1 is accomplished at the first station by selectively subjecting the panel area 14 to the action of a plurality of bulging elements, e.g. two spherically or frusto-conically shaped bulging pins or punch elements 32 of different sizes and a further punch 34 provided with an offset or eccentrically arranged and preferably flat topped head 36. Two of the initially formed dimples are then each reworked and reshaped at the second station into push button tabs 20 and 20' provided with a central dome-like section 27, and two base sections 21 and 22 interconnected by a web section 24, made up of a tear line 24' and hinge 25. The large tab 20 is further provided with a differentially or more work hardened tear line sector 24'' and a force application indicator element 23' in its dome-like section 27.

As indicated in FIGS. 5–10 one type of standard press that can be used to form the easy open end closure of FIG. 1, can comprise a conventional, fixed base plate or platen 38 and a cooperating movable top platen 40 that is operated in a manner well known in the art. At the first station, a lower die segment 42 is attached to platen 38 and an upper die segment 44 is attached to movable platen 40. Lower die segment 42 is secured by a plurality of machine bolts 45 in the usual fashion to the fixed platen 38, while upper die segment 44 is connected by suitable machine bolts (not shown) to holder 44', which in turn is secured by bolts 46 to movable platen 40. The lower die segment 42 can be provided, if desired, with a locating stem or pin 48 that fits in a suitable opening 50 of platen 38.

Frusto-conically headed punches 32 along with punch 34 fit within the bores 52, 54 and 56 of the punch holder making up the lower fixed die segment 42. Formed integrally with the punches are the shoulder elements 58 and 60 on the respective punches 32 and 34 and these shoulder elements fit within the stepped openings 62 of die segment 42. If desired, or necessary, spacers or shim members 64 may be sandwiched in between the press bed platen 38 and the punch holder die segment 42 prior to locking the segment 42 to the press bed platen 38 by the machine bolts 45 aforementioned.

The punches or pins are held within the die segment 42 by virtue of the shoulder elements 66 defining the stepped openings 62 and, if desired, shim elements (not shown) may be located intermediate the shoulder elements 66 and the shoulder sections 58 and 60 of the various punches.

Figure 6:
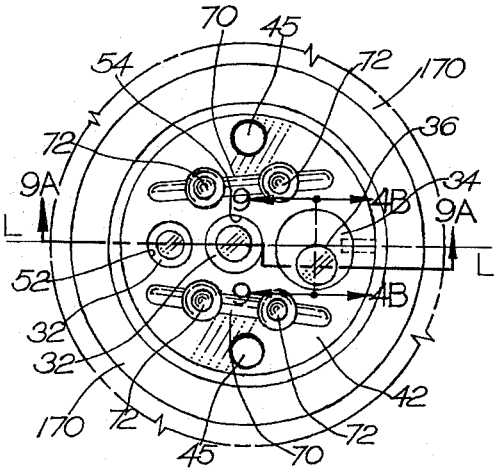
FIG. 6 is an end view with parts removed of the fixed die part of the first station tooling and when taken along line 6—6 of FIG. 5.

Along with punches 32 and 34, the lower die segment 42 is provided, as indicated particularly in FIG. 6, with a pair of raised and elongated rib or bar-like surfaces 70 arranged preferably in a somewhat converging fashion and in one embodiment of the invention extending for a substantial distance across the bottom of the die segment 42 in order to provide or form the raised embossments 28 on the end closure 10. The height of bars 70 can, if desired, be equal to or slightly less than the height of the punches 32 and punch head 36. At appropriate spaced points along each of these bar elements is one or more beads or button heads 72 of an appropriate shape, e.g. hemispherical or frustoconical, etc. The height of beads 72 which form the protective embossments 27 in the final end closure 10 should be somewhat higher, e.g. on the order of ten or more thousandths of an inch higher, than the tops of the individual punches 32 and punch head 36.

Beads 72 in one embodiment of the invention can all be located at the same distance or at the same radius from the main center point of the die segment 42 in order to form protective closure member embossments 27' that will be located at points on the same circle drawn from the center or central axis of end closure 10 and which would come into contact with the seam tool pushout element during the seaming of the closure member 10 to a standard sized beverage can. Although beads 72 are shown in FIG. 6 as being formed integrally with a raised rib 70 of the dies, they can also be made in the form of removable pins in the manner shown and discussed in the aforesaid Gane application Ser. No. 478,407.

The annular die segment 44 that is cooperatively associated with lower die segment 42 at the first station includes an apertured upper spacer member 74 sandwiched in between the upper die segment 44 and holder 44'. Die segment 44 is adapted to be fitted with a centering sleeve or ring 76 held in place by an annular retainer shoulder 77, while being biased relative to the die segment 44 by means of the standard spring elements 80 fitted in separate cavities 82 in the upper shoulder portion of ring 76. As indicated particularly in FIGS. 5 and 6A the biasing or centering ring 76 with its nose portion 84 is usually maintained in an extended position with respect to the lower portions of the die segment 42. The nose 84 of ring 46 is adapted to fit within the rib 16 of the closure member 10 in order to initially engage and center this closure member relative to the lower and upper die segments 42 and 44. This ring operates further to hold the closure member 10 in the proper position against the several bulging punches 32 and 34 of the lower die segment 42 throughout the first station forming operations.

The upper die segment 44 further includes as indicated in FIG. 5 the main die cavities 86, 88 and 90, which cooperate respectively with punches 32 and the head 36 of punch 34 to initially form the dimples that form embossment 18 or are to be reformed into tabs 20, 20'. Die cavity 86 can be formed as a continuation or enlargement of a main bore 92 while the other cavities simply comprise singular bores. The upper part of bore 92 can be designed to receive die segment centering pin 94 which also protrudes through appropriate aligned openings in the shim member 74 and holder 44'. Die segment 44 may also be equipped with a further centering pin 96 that fits in openings 98 in holder 44'.

Figure 6A:
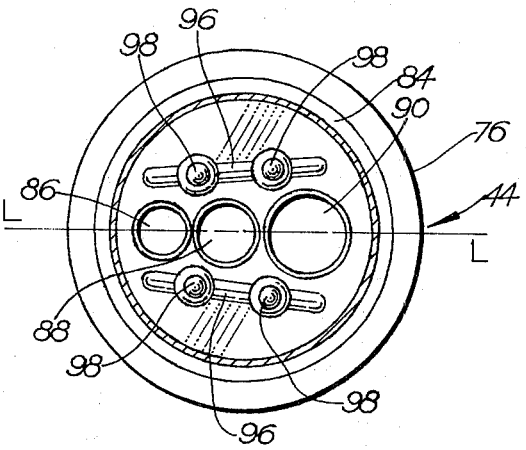
FIG. 6A is an end view with parts removed of the movable die part of the first station tooling and when taken along line 6A—6A of FIG. 5.

Die segment 44 is further provided with elongated and converging rib-like cavities 96 and enlarged openings 98 of the type indicated in FIG. 6A, that are adapted to cooperate with ribs and beads 70 and 72 of die segment 42 to form stiffening embossments 28 and the protective and raised embossments 27'. It is to be noted that the overall press apparatus 30 is equipped with the usual cooperating bottom and top stop elements (not shown), which selectively limit the movement of the movable top press section 40 and its associated die segments relative to the fixed base 38.

The second station of press 30 is provided with a die set comprised of lower and upper die segments 100 and 102. Fitted within each of the bores 101 and 101' of lower die segment 100 are small and large die inserts 104 and 104' respectively that are held in place by the usual machine bolts 106 and 106' and side pins 108 and 108'. Since each die insert 104 and 104' is generally similarly constructed and configured, a description of one will suffice for both. The larger die insert for producing tab 20 and its associated elements have been and will be referenced with numbers having the prime symbol (') and this die insert will be particularly discussed because of its function in producing the finally shaped large tab 20 with tear line sector 24''.

Die insert 104' is provided with a plurality of aligned bores 103', 105' and 107'. Bore 107' communicates at the bottom with air holes 109' and at its top with a generally inverted frusto-conical surface 110'. Bore 105' is threaded and receives machine bolt 106' used to anchor insert 104' to die segment 100' in the usual fashion. As indicated in FIG. 7, die segments 100' is anchored to platen 38 by machine bolts 45.

Figure 7:
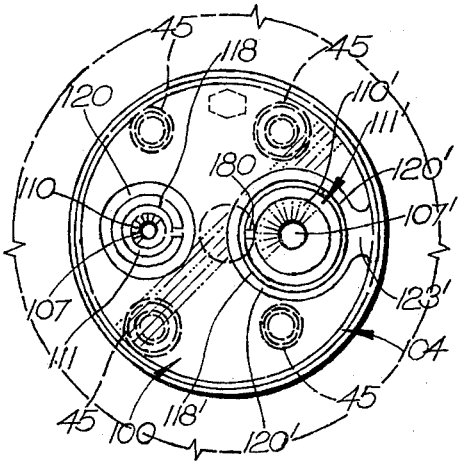
FIG. 7 is an enlarged end view with parts removed of the fixed die portion of the second station tooling when taken along the line 7—7 of FIG. 5.
Figure 8:
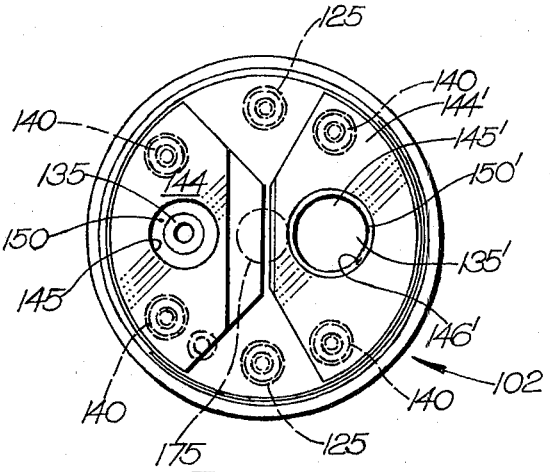
FIG. 8 is an enlarged end view with parts removed of the movable die portion of the second station tooling when taken along line 8—8 of FIG. 5.
Figure 10:
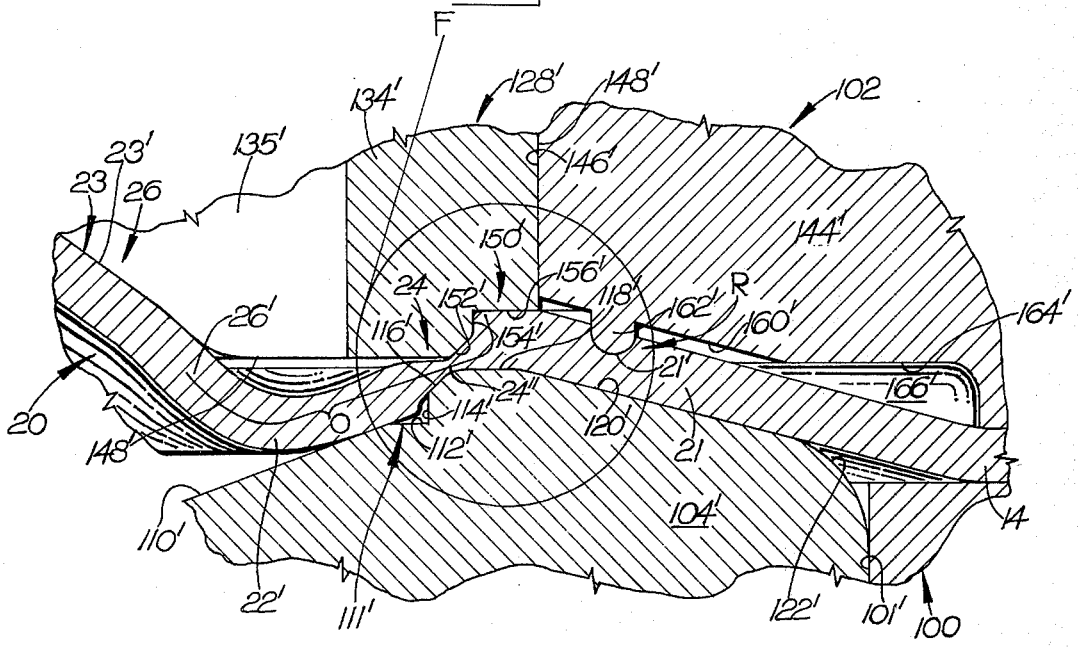
FIG. 10 is an enlarged cross-sectional view taken along line 10—10 of FIG. 5 with a portion of an end closure being added and discloses the manner in which the tools produce the improved differentially work hardened tear line sector and the contiguous secondary and primary base sections of a depressible tab for the container closure of the instant invention.

As indicated particularly in FIGS. 7 and 10, the outer edges of inverted frusto-conical surface 110' merge with the annular stepped shoulder portion 111' of the die insert 104', that is of particular significance in forming the web portion 24, tear line 24' and extra work hardened sector 24'' of the tear line 24' of large tab 20. Stepped shoulder portion 111' comprises in vertical cross-section a small flat base 112', a vertical wall 114' that merges with an upwardly and outwardly inclined surface 116' followed by a flat crest 118' that merges with a further downwardly and outwardly inclined die surface 120'. The outer edge of die surface 120' is followed by a gentle arc 122' that terminates at the vertical wall of the die insert 104'. During final forming of tab 20 the tab base 21 thereof is supported by the peripheral top area of die insert 104'. As indicated in FIG. 7, in a further embodiment of the invention, it will be noted that in the case of the die insert 104' for the large tab 20 the outer peripheral surface 120' contains a cut out area 123' at the point where insert surface 120' is located in somewhat tangential fashion most closely adjacent the outer periphery of die segment 100. This is to permit proper die clearance between the die segments 100 and 102 and the finally formed large tab 20 in the area of merger between tab and rib 16 in the finally formed closure member 10.

The upper movable die segment 102, which as shown in FIG. 10, cooperates with a lower die segment 100 at the second station, is fitted to movable die platen or plate 40 by means of a die plate 122. Plate 122 is directly anchored to platen 40 by bolts 123, with die segment 102 then being directly anchored to plate 122 by means of the usual machine bolts 125 of FIG. 8. Die segment 102 is also fitted with a centering ring 76 similar in structure and function to ring 76 for die segment 44 at the first station.

Die segment 102 is provided with small and large bores 126 and 126' respectively for receiving the small and large die inserts 128 and 128' which cooperate with their associated lower small and large die inserts 104 and 104' to finally shape and form the small and large depressible tabs 20' and 20. Since both top die inserts, except for size, are substantially similarly constructed and shaped, a description of one such as the large die insert 128' will suffice for both with reference numerals having a prime symbol (') being used for the large die insert 128' and its associated elements.

Die insert 128' is locked in place in bore 126' in a conventional manner by a machine bolt 130' and a locating and turn resistant pin 131'. Shim elements or spacers 132' may be used in the die insert holder 126' for the purpose of obtaining the proper seating of the die insert 128' in its bore. Similar spacers can be used in the case of lower inserts 104 and 104'. The nose portion 134' of an insert 128' is provided with an annual die cavity or recess 135' for receiving, as indicated particularly in FIGS. 8 and 10 of the drawings, the initial and partially formed dimple that is later reshaped and expanded to become the full dome-like section 27 of the depressible tab or button 20.

Cavity section 135' is of a smaller peripheral dimension than and opposes the inverted frusto-conical surface 110' of a lower die insert 104' while cooperating with surface 110' to finally shape tab 20 as will be hereinafter described. Affixed to the lower portion of die segment 102 by the appropriate machine bolts 140 of FIG. 8, for example, and separated from the main portion of die segment 102 by a spacer 142' is stepped insert guide and protective plate 144'. Plate 144' is provided with an opening 146' alignable with opening 126' for receiving nose portion 134' of die insert 128'.

The lower section of the cavity 135', as indicated in FIG. 10, for the larger die insert terminates in an annular surface 148' followed by an annular stepped shoulder section 150'. Shoulder section 150' is of particular significance in that during the bottoming of the various die elements at the second station it cooperates with the opposing stepped shoulder section 111' of the die insert 104' in the forming area F, shown in dotted lines in FIG. 10 to form the web section 24 of depressible tab 20 made up of frangible tear line 24' the extra work hardened sector 24'' of the tear line and hinge 25. In this connection it is to be noted that, although not shown, an appropriate area of shoulder section 150' is hollowed out or notched as noted in the aforesaid application Ser. No. 478,407 of Gordon R. Gane to cooperate in a standard fashion with the raised element 180 of die segment 140 (see FIG. 7) to form the generally downwardly directed tab hinge 25 at the same time tear line 24' and its sector 24'' are formed.

Shoulder section 150' of FIG. 10 in vertical cross-section includes an upwardly and outwardly inclined surface 152' followed by a short vertical wall 154' that merges with a flat surface 156' disposed at an appropriate angle to wall 154'. Surface 156' merges with the vertical wall 148' of the nose 134' of die insert 128'. Also partly located in the forming area F is the somewhat conically shaped lower downwardly and outwardly inclined surface 160' of the nose guide segment 144'. The outer periphery of surface 160' merges with the wall 164' of the pocket 166' in the nose guide segment 144'. All of the aforesaid elements of a die insert 128' and a guide plate segment 144' act during the stroke of the press in conjunction with the top portions of a die insert 104' to finally shape the bases 21, 22, web 24, including tear line 24', tear line sector 24'' and hinge 25 and dome section 27 including the annular recess 21' in the base 21 of a tab 20 at the second station. It is to be noted that where, as indicated, different sized tabs 20 and 20' are produced, the location of the embossment 18 will be somewhat offset relative to the center of panel 14, while still being located adjacent the panel center and preferably equidistant from the innermost adjacent edges of each differently sized tab.

The process for forming an improved closure member of the instant invention will now be described with particular reference to making a closure member having tab designs of the type shown in FIG. 1 in a two step or two station process and while using tooling of the type shown. A two step process is preferred because it minimizes the necessity for severly forming or cold flowing the metal of the closure member in a single operation with possible fractures and multiple rejects and more readily permits the selective work hardening of tear line 24' and its extra work hardened sector 24'' in the case of at least one tab, e.g., tab 20. Accordingly, in a preferred embodiment of the invention, it is contemplated that the end closures 10 be fed from one station to another of the press 30 by being passed across and between the opposing upper and lower die elements of the first and second stations and with sufficient dwell time being allowed at each station for the respective die elements located at each station to perform the particular forming steps desired. This can all be accomplished by using the web conveyor W as aforedescribed. If desired, the individual stations can be provided with appropriate means for removing the end closure blank from a given station after being worked at such station. This means could comprise standard stripper rail devices 170 as shown in FIG. 5 and operated in accordance with the well-known practice in the art to displace the web W and an end closure member upwardly relative to a die, after the end blank 10 has been worked at one station and is to be transferred to the next station.

Figure 9:
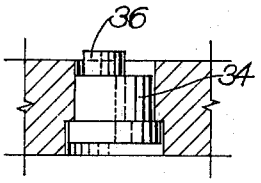
FIG. 9 is a sectional view of the tooling of FIG. 6 when taken along the line 9—9 thereof, and with parts removed.
Figure 9A:
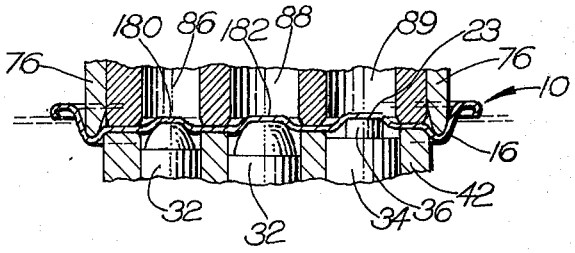
FIG. 9A is an enlarged cross-sectional view of parts of the die elements at the first station as they complete the initial formation of the dimple like structures making up the central embossment and side tabs, when taken along line 9A—9A of FIG. 6.

As each closure member 10 moves between the upper and lower die segments 42 and 44 at the first station, it would be initially engaged on the downward stroke of the press by the nose tip 84 of the first station's centering ring 76, as the nose tip fits within the rib 16 of the end closure 10 and acts to center the closure member with respect to the fixed bulging pins 32 and 34 of the lower die segment 42. As the die segment 44 continues to move down the two pins 32 and the head 36 of pin 34 engage the panel portion 14 of the end closure 10 and act to draw or force several selected areas of panel portion 14 slightly upwardly into the die cavities 86, 88 and 90 to initiate formation of the tabs 20 and 20' and the formation of embossment 18. All of this takes place with controlled cold flowing of the metal and with but negligible or minimal stretch forming or thinning of the metal in substantially all of the dimple and embossment wall structures except possible at the crest or the extreme top portions of the dimples and embossment and even then such thinning is usually minimal. As this initial drawing takes place, and as indicated in FIG. 9A, the initial dimple structures 180 and 182 for the finally formed small tab 20' and embossment 18 will be generally symmetrical and if the specific tooling of FIGS. 5, 6 and 6A is used these structures can have a somewhat frusto-conical shape. At the same time, however, the initial dimple structure for large tab 20 at the first station will have an initial central vertical axis M indicated by the solid vertical line of FIG. 7B, that is offset relative to the horizontal center line of the tooling shown in FIGS. 6 and 6A or a line L drawn through the center points of the two bulging pins 32 and extended across the center of pin 34. Thus, at this stage of its formation tab 20 will assume the approximate unsymmetrical shape of the partial raised element 23 shown in full lines in FIGS. 4B and 4D in contrast to the symmetrical shape of the dimples 182 and 180 for embossment 18 and small tab 20'. This unsymmetrical shape and offsetting of the central axis M of the initial tab structure 23 results from the bulging action of off-center pin head 36 on pin 34 that forms section 23. As this off-center draw forming occurs all as indicated particularly in FIGS. 4B and 4D, a first operation partial work hardening of the metal making up tab 20 will take place primarily in the selected metal area generally designated by the letter O, which later becomes tear line sector 24'' as well as partial wall 26', and at least the parts of base sections 21 and 22 of the final tab 20 contiguous to sector 24'' and identified by reference numerals 21' and 22' in FIGS. 4A and 4C. In the metal areas of the panel 14 that are spaced progressively further and further away from or off to the side and back and away from metal area O and partial raised element 23 progressively less and less metal working takes place during the first station forming operation.

Some small amount of metal thinning may occur in the top of the partial raised element 23 as well as in the tops of the small tab dimple and embossment 18 during this initial working at the first station. Thus, for example, if the starting material of an end closure 10 having an outside diameter of approximately 2⅞ inches were made of a readily ductile and workable aluminum alloy of the appropriate hardness or temper such as 5182 aluminum alloy, the number designated for the same by the American Association, and of about a ¾ hard temper, e.g. H26 temper and of an initially 0.013 inch thickness or gauge, the reduction in the thickness during the first forming step of the central embossment 18, the side dimple for small tab 20' and the unsymmetrical partial raised element 23 for large tab 20 may at the most be on the order of about 0.001 to 0.002 inch and then substantially all such thinning would normally take place in the crests of the initial dimples 180 and 182 and raised element 23. At the same time, as the embossment and tab dimples are initially formed, stiffening ribs and protective beads 28 and 27' are also formed.

After the first station forming of the tab dimples and embossment takes place as viewed in FIG. 9A and with appropriate heights and diameters being given to the small tab dimple 180 and the embossment 182, the closure member 10 is released from the die elements of the first station in a manner well known in the art. Thus as press 30 opens the stripper elements 170 will be moved upwardly against the bottom of belt conveyor W, and the closure member in the first station and the belt conveyor W appropriately activated to move the blank from the first to the second station as an additional end closure 10 is introduced simultaneously to the die set at the first station, so that it can be initially worked simultaneously with the reworking of the first mentioned end closure now at the second station.

When the partially formed end closure 10 enters the second station it is initially engaged by the second station's spring biased centering ring 76. As the centering ring 76 of the second station becomes seated in the rib 16 of the end closure 10, the press platen 40 moves down. This second station ring 76 operates to center and hold the end closure in place with respect to the second station tool elements during all metal working operations at the second station. Thereafter, as the tooling edge portions of the top die segment 102 move down and into full contact with the panel section 14 of the end closure 10, the dimple 182 for embossment 18 can be either reformed or simply in a preferred embodiment of the invention allowed to fit freely within the central cavity portion or space 175 defined by the stepped portions of protective plate elements 144 and 144' between die inserts 128 and 128'. There it can remain relatively undisturbed during the further working and reshaping of the partly drawn portions 180 and 23 of panel 14 used to produce the generally concentric outer and inner tab base portions 21 and 22, etc. and the final structures of tabs 20 and 20' of differing diameters.

As the upper die segment 102 at the second station moves downwardly and with the initially formed central embossment 18 fitting within the space 175 as noted, the areas of panel section 14 constituting the original base of dimple 180 for the small tab 20' and the areas of metal constituting and adjacent to the base of the raised and offset element or section 23 including in particular metal in the area O of FIGS. 4B, 4D and 10, are subjected to the controlled and progressive forming pressure of the tooling at the second station and shaped into the primary and secondary tab base sections 21 and 22 joined together by the web sections 24 made up of the thinned split tear lines 24', that includes a tear line sector 24'' in the case of large tab 20, and tab hinges 25.

As this reshaping and draw forming of the metal in the panel 14 takes place, the upper portion of the outermost dimple 180 for tab 20' and the unsymmetrical metal section 23 are also caused to be somewhat reshaped and displaced slightly upwardly in a controlled fashion into their associated die cavities 135 and 135' without substantially any further thinning taking place in the wall 26 proper of the tabs and finally shaped dome section 27. As raised section 23 is deflected upwardly, it is also expanded and its surface 23' angularly tilted several degrees to the right as viewed in FIG. 4B so as to assume the position shown in dotted lines in FIG. 4B where it constitutes an eccentric raised surface element. This metal movement also causes the location of the central vertical axis M of the tab 20 established or delineated by eccentric element 23 at the first station to be shifted and lined up with those of the tab 20' and embossment 18 or along main center lines L of FIGS. 6 and 6A and in the manner indicated in dotted lines in FIG. 4B. In the final end closure structure the preferred embodiment of the invention contemplates that the tab dome section 27 and embossment 18 for the various tabs would be relatively shallow and project somewhat below the top plane of rim 12 and beads 27' to preclude stacking problems, accidental tab openings, etc.

From the above it will be observed that the greatest work hardening of metal in panel section 14 of tab 20 of end closure 10 from cold working at the second station takes place primarily in the panel area or zone O of metal previously worked at the first station. As noted above this includes in particular the sector 24'' of tear line 24' of the large tab 20, and the contiguous portions 21' and 22' of base sections 21 and 22. This extra work hardening is due to the action of the tooling of the second station as the large cooperating die inserts in the upper and lower die segments of the second station tooling reposition the central vertical axis M of tab 20 as the tooling rotates the surface 23' of eccentric element 23 while expanding element 23 into dome section 27. When eccentric surface 23' is rotated it is integrated with dome section 27. This extra or differential work hardening and embrittlement of sector 24'' of the tear line as compared to the remaining sections of tear line 24' of the large tab 20 all mean that sector 24'' will be the part of the tear line 24' of tab 20 that will be the first part of line 24' to rupture, when a downward force is applied to the eccentric surface element 23' of the dome section 27 of tab 20 because it becomes the focal point of stress concentration.

In the cold working operation that takes place at the second station, there is substantially no thinning of metal in the base sections 21 and 22 of a finally formed tab 20 and 20' except that resulting when ribs 162 and 162' are used in the tooling at the second station. In contrast, however, since the metal areas making up the tear line sections 24' of tab webs 24 are subjected to tool pressure from both sides, they become substantially thinner than the remaining portions 21, 22 and 26 of the final tabs 20 and 20'. For example, the web section 24 with the exception of hinge 25 and, in particular, sector 24'' of large tab 20 is severely cold worked from both sides and substantially reduced in thickness such that in the case of the closure 10 having an original blank thickness of 0.013 inch, the frangible tear or residual line 24' of web 24 could be thinned to between 0.003 inch and 0.0015 inch thickness or to as low as less than one-eighth of the original thickness of such end closure blank without fracture during formation.

During the cold working and thinning of tear line section 24' at the second station, tear line section 24' is, as indicated in FIG. 4A, also oriented preferably at about a 45' outside or exterior angle to the normal plane of the panel portion 14 in the case of both tabs 20 and 20'. Since the frangible web section 24' is advantageously formed by opposing indentations or bilateral scores on each side of the metal, this has the advantage of controllably cold flowing the metal in a substantially uniform fashion away from the web section 24 on both sides of the metal closure member and along the entire length of the tear line.

If desired and in order to further aid in controlling the cold flow of metal and particularly the excess metal of a tab web 24 that builds up in the sector F of FIG. 10 and to direct it away from web section 24' and toward the interior of die cavities 135 and 135', the lower inclined wall 160 or 160' of a nose guide segment 144 or 144' adjacent a shoulder section in a given die cavity can be provided with an annular rib 162 or 162' as the case may be. Such a rib impresses the small shallow annular depression 21' in a tab base 21 and acts as a dam to retard and prevent excessive cold flow of metal outwardly away from lower and upper tooling shoulder sections 111, 152 and 111', 152' and the metal tear line section 24' of a tab 20 and 20' during the formation of the same. At the same time, the metal in the zone R in the base 21 of a tab will form a stiffening band of somewhat more work hardened metal than in other parts of base 21. The depth of the depression 21' can be controlled by the vertical length of a rib 162 or 162' and/or the amount of final downward movement of a nose element relative to a die surface 120 or 120'. Likewise, the final thickness of residual section 24' is determined by the amount of downward movement of the nose of a die insert, e.g. insert 128' relative to its cooperating die insert 104' and all of which can be somewhat greater or lesser than is illustrated in FIG. 10.

In a preferred embodiment of the invention and as indicated in FIG. 4C the eccentric surface 23' that forms the force application indicator device in the final dome structure of a tab 20 is located within a triangle made up of point $P_1$ located adjacent the raised element 23', point $P_2$ or the point of the base 21 located closest to the peripheral edge of the closure member 10 and the point $P_3$, a point located in the area of the hinge 25 of the tab 20. Eccentric surface 23' is located closely adjacent point $P_1$ and remote from point $P_3$.

Although the invention has been discussed with reference to the use of two push button tabs, it is applicable to the use of but a single tab provided with the differentially worked and embrittled tear line sector 24'' and an adjacent force application indicator device 23' on dome section 27. When larger and smaller size push button tabs are used together, the large depressible tab can be used for pouring the contents of the container, while the smaller depressible tab, which is adapted to be opened first, is utilized to relieve the pressure from inside the container, when the container is used to merchandise beer or a carbonated beverage, etc.

Advantageous embodiments of the invention have been disclosed and described and various changes can be made therein without departing from the inventive concepts as defined in the appended claims wherein:

What we claim is:

1. An easy open metal closure member comprised of a main panel encompassed by a rim and at least one reinforcing peripheral rib, a panel stiffening embossment means at least part of which is formed in the panel adjacent the central portion thereof and at least one outwardly projecting button-like depressible tab formed in said panel intermediate a selected portion of the peripheral rib and the stiffening embossment means, said depressible tab being provided with selectively offset concentrically arranged and interconnected primary and secondary base sections and an outwardly projecting dome-like section, said primary base section being generally inclined upwardly and inwardly and said secondary base section projecting generally downwardly and inwardly to merge with the wall of the dome-like section and both of said base sections having hoop-like strength characteristics, web means disposed at least in part at an angle to the normal plane of the panel and interconnecting said base sections, said web means being comprised of an embrittled and readily frangible tear line portion that extends for a selected length of said web means and a hinge portion, a selected sector of the tear line portion spaced a predetermined distance from the hinge portion being more work hardened and embrittled than the remaining sectors of the tear line portion, force application indicator means integrated with the structure of the dome-like section and located substantially immediately adjacent the said selected sector of the tear line portion, the frangible tear line portion of the web means and the normal slope of a selected part of the wall of the dome-like section adjacent the wall's point of mergence with the secondary base section when projected along hypothetical lines also forming opposing and intersecting cone-like geometrical figures and said frangible tear line portion being of substantially less thickness than the adjacent base sections whereby when an external and inward force is applied to said dome-like section in the area of said force application indicator means said tear line portion sector will become the focal point of stress concentration and readily fracture to allow the dome-like section of the tab to pivot inwardly about the hinge portion.

2. A closure member ad defined in claim 1 wherein a part of one of the base sections of the tab that is contiguous to the selected sector of the tear line portion is also more work hardened than other portions of the same base section.

3. A closure member as defined in claim 1 wherein a part of the primary base section of the tab is located contiguous to said peripheral rib.

4. A closure member as set forth in claim 1 wherein the more work hardened sector of the tear line portion is also spaced a selected distance from said peripheral rib.

5. A closure member as set forth in claim 4 wherein the more work hardened sector of the tear line portion is located substantially within and adjacent an inside angle of a triangle the points of which are generally defined by the work hardened sector of the tear line portion, said hinge portion and said peripheral rib.

6. A closure member as set forth in claim 4 wherein an area of the secondary base section of the tab that is contiguous to the selected sector of the tear line portion is also more work hardened than other portions of the secondary base section.

7. A closure member as set forth in claim 1 wherein the force application indicator means comprises a raised surface element eccentrically arranged on said dome-like section.

8. A closure member as set forth in claim 1, wherein the closure member is provided with a tab protective embossment of a greater height than said embossment means and said tab.

9. A closure member as set forth in claim 1 wherein the force application indicator means comprises a minor part of the tab dome-like section.

10. A closure member as set forth in claim 1 wherein the tear line portion of the web means extends for the major length of the web means.

11. An easy open metal closure member comprised of a main panel encompassed by a rim and at least one reinforcing peripheral rib, a panel stiffening embossment means at least part of which is formed in the panel adjacent the central portion thereof and at least one outwardly projecting button-like depressible tab formed in said panel intermediate a selected portion of said rib and the embossment means, said depressible tab being provided with selectively offset concentrically arranged and interconnected primary and secondary base sections and an outwardly projecting dome-like section provided with symmetrical and unsymmetrical wall portions, said primary base section being generally inclined upwardly and inwardly and said secondary base section projecting generally downwardly and inwardly to merge with the wall of the dome-like section and both of said base sections having hoop-like strength characteristics, web means integral with said base sections and disposed at least in part at an angle to the normal plane of the panel and interconnecting said base sections, the angularly disposed part of said web means being comprised of an embrittled and readily frangible tear line portion that extends for a selected length of said web means and said web means also including a hinge portion, a selected sector of the tear line portion that is spaced a predetermined distance from the hinge portion being more work hardened and embrittled than the remaining sectors of the tear line portion, said unsymmetrical portion of the dome-like section being located substantially immediately adjacent the selected sector of the tear line portion and constituting a force application indicator means, the frangible tear line portion of the web means and the normal slopes of selected parts of the symmetrical and unsymmetrical in wall portions of the dome-like section when projected along hypothetical lines forming opposing intersecting and cone-like geometrical figures the apex of one of which is offset relative to the central vertical axis of the tab, and said frangible tear line portion being of substantially less thickness than the adjacent base sections whereby when an external and inward force is applied to the force application indicator means of the dome-like section the tear line portion sector will become the focal point of stress concentration and readily fracture to allow the dome-like section of the tab to selectively pivot inwardly about the hinge portion of the web means.

12. A closure member as defined in claim 11 wherein an area of the secondary base section of the tab that is contiguous to the selected sector of the tear line portion is also more work hardened than other portions of the secondary base section.

13. A closure member as set forth in claim 11 wherein a portion of said primary base section of the tab is contiguous to said peripheral rib.

14. A closure member as set forth in claim 11, wherein the more work haardened sector of the tear line portion is also spaced a selected distance from said peripheral rib.

15. A closure member as set forth in claim 11 wherein the more work hardened sector of the tear line portion is located substantially within and adjacent an inside angle area of a triangle generally defined by the work hardened sector of the tear line portion said hinge portion and said peripheral rib.

16. A closure member as set forth in claim 15, wherein an area of the secondary base section of the tab that is contiguous to the selected sector of the tear line portion is also more work hardened than other portions of the secondary base section.

17. A closure member as set forth in claim 11 wherein the force application indicator means comprises a raised surface element eccentrically arranged on said dome-like section.

18. A closure member as set forth in claim 11 wherein the closure member is provided with a tab protective embossment of a greater height than said embossment means and said tab.

19. A closure member as set forth in claim 11 wherein said force application indicator means comprises a minor part of the dome-like section.

20. A closure member as set forth in claim 11 wherein the tear line portion of the web means extends for the major length of the web means.

21. A closure member as set forth in claim 11 wherein the panel further includes a pair of bar-like embossments together with tab protecting upstanding embossments formed integrally with said bar-like embossments and said tab protecting embossments being of greater height than said tab and said stiffening embossment means.

* * * * *